United States Patent [19]

Cooke et al.

[11] Patent Number: 4,498,249

[45] Date of Patent: Feb. 12, 1985

[54] DRYER STATIONARY SYPHON ADJUSTMENT MECHANISM

[75] Inventors: Ronald D. Cooke; Neil A. Laage, both of Beloit, Wis.

[73] Assignee: Beloit Corporation, Beloit, Wis.

[21] Appl. No.: 430,948

[22] Filed: Sep. 30, 1982

[51] Int. Cl.[3] ..... F26B 13/08

[52] U.S. Cl. ..... 34/125; 34/119

[58] Field of Search ..... 34/119, 124, 125; 165/89, 90

[56] References Cited

U.S. PATENT DOCUMENTS

| | | | |
|---|---|---|---|
| 1,715,677 | 6/1929 | Ritchie | 34/125 |
| 1,953,525 | 4/1934 | Young | 34/125 |
| 2,978,815 | 4/1961 | Hieronymus | 34/125 |
| 3,034,225 | 5/1962 | Hieronymus | 34/125 |

*Primary Examiner*—Larry I. Schwartz

*Attorney, Agent, or Firm*—Hill, Van Santen, Steadman & Simpson

[57] ABSTRACT

A mechanism for drying a traveling web such as employing a steam heated dryer drum in a papermaking machine with the drum being supported on end bearings in journals in a frame and a rigid condensate removal tube extending through one of the journals with its inner end adjacent the inner surface of the drum and the drum having a rotary steam seal through which the tube passes with a pivotal mount for the rigid tube and a micrometer adjustment which adjusts the pivotal position of the tube so that the inner end of the tube being cantileverly supported can be adjusted accurately relative to the inner surface of the drum.

6 Claims, 2 Drawing Figures

DRYER STATIONARY SYPHON ADJUSTMENT MECHANISM

BACKGROUND OF THE INVENTION

The invention relates to improvements in dryer drums, and more particularly to an improved paper machine dryer drum with a condensate removal adapted and constructed for accurate adjustment for improved condensate removal from the drum.

Such dryer drums are heated by live steam directed into the interior and a continuous web of paper is threaded in serpentine fashion over a series of dryer drums. As the heat energy from the steam within the dryer drum transfers as heat through the shell of the hollow cylindrical drum to the paper web, condensate is formed within the drum. This condensate tends to collect on the inner cylinder surface of the drum or to "rim" as the drum rotates, and the condensate is removed by a condensate removal syphon tube. Because the condensate provides an insulation effect, the layer of condensate must be maintained at minimum thickness for the most effective heat transfer. The effective removal of the condensate is directly related to the spacing between the inner end of the syphon tube and the inner surface of the drum.

In devices heretofore available, different arrangements were employed for adjusting the spacing between the inner end of the syphon tube and the drum. This creates difficulties because with heat expansion and contraction of the drum, the spacing can change, and it is desirable that the adjustment can be accomplished during operation inasmuch as it would be completely impractical to have to shut down the operation of the paper machine for this adjustment. One arrangement for adjusting the end of the condensate tube relative to the drum surface is shown in U.S. Pat. No. 1,953,525 wherein it is necessary to provide a flexible condensate syphon tube which can pivot within the drum. Structures of the type shown in this patent encounter disadvantages in that there is an instability in having to provide a flexible tube, and mechanism and equipment is required which operates inside of the dryer drum and is subject to vibration, going out of adjustment, and inaccessibility for repair and observation.

Accordingly, an object of the present invention is to provide an improved dryer drum and syphon for condensate removal which is of an improved simplified construction and which is more reliable in operation.

A further object of the invention is to provide an improved adjustment mechanism for the syphon tube of a steam dryer drum where it provides a minute and accurate control of the position of the inner end of the tube relative to the drum wall and which adjustment can be effected at anytime during operation of the drum.

A still further object of the invention is to provide an improved adjustment mechanism for locating the inner end of the condensate syphon tube of a steam drum relative to the inner wall of the drum which makes possible minute adjustment and wherein the operating portions are outside of the dryer drum where they can be easily reached and serviced.

Other objects, advantages and features will become apparent with the teaching of the principles of the invention in connection with the disclosure of the preferred embodiments in the specification, claims and drawings, in which:

DESCRIPTION

Figure 1:
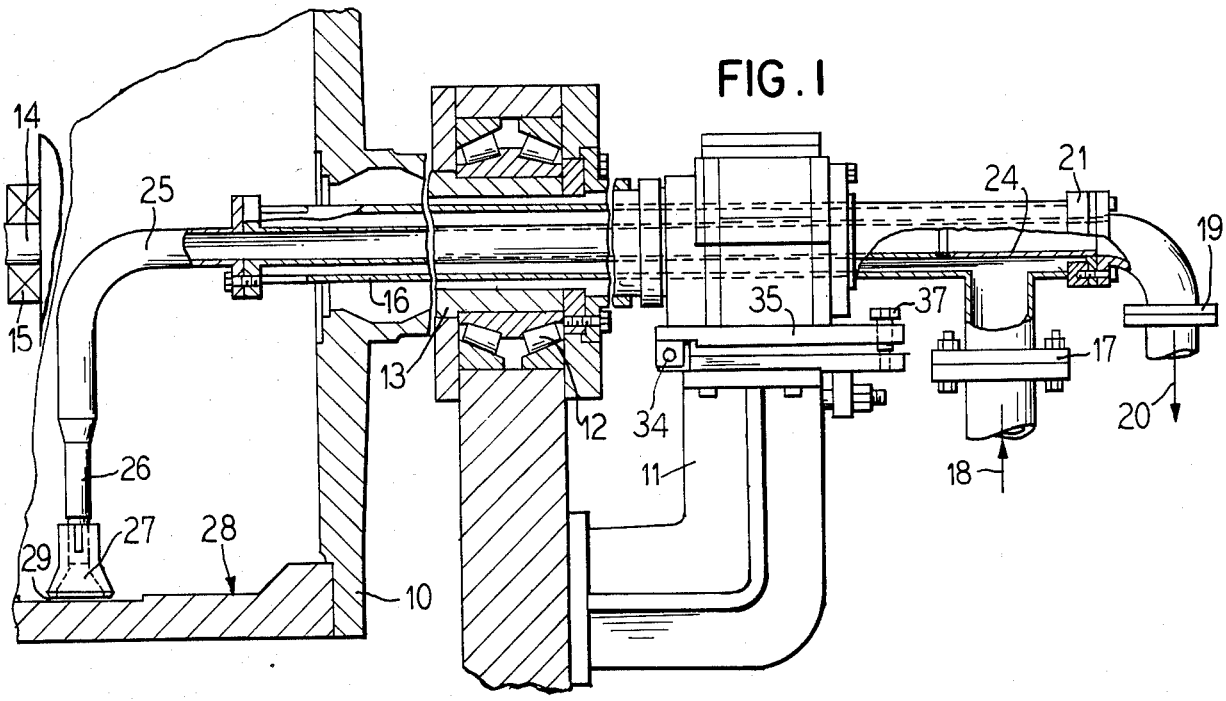
FIG. 1 is a somewhat schematic vertical sectional view taken through a dryer drum constructed and operating in accordance with the present invention.
Figure 2:
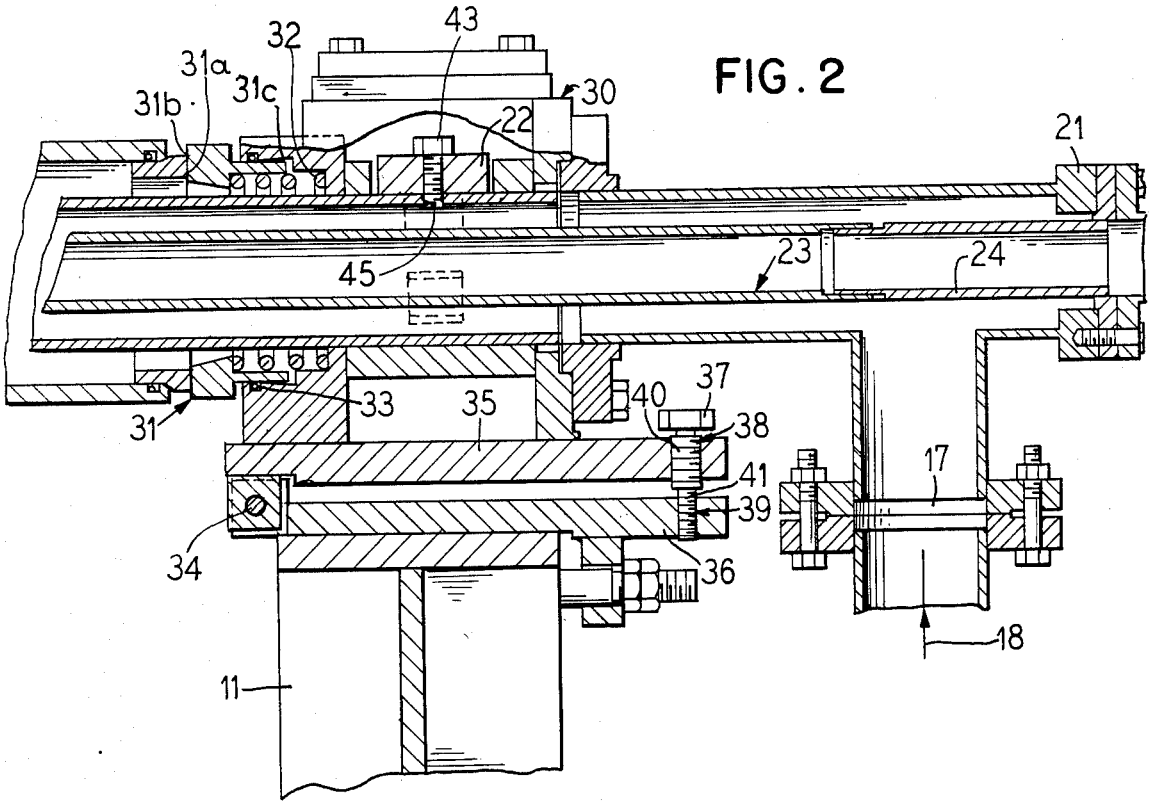
FIG. 2 is a fragmentary detail view illustrating the adjustment mechanism for the syphon tube.

The drawings show a rotatable steam dryer drum 10 which has a cylindrical hollow shell for receiving steam therein and for carrying a paper web on its outer surface to be dried. The drum is supported on journals 13 and 14 at its ends which are mounted in stationary bearings 12 and 15 carried on a frame member 11. Suitable means may be provided for rotating the drum, or the drum may be rotated by engagement with the web or with felts carrying the web.

For delivering steam to the inside of the drum, a coaxial steam delivery tube 16 leads through the journal 13 and opens into the interior of the drum. Steam is supplied from a supply pipe 18 connected by means of a flange 17. The supply piping will have sufficient flexibility to permit slight movements of the flange as will later appear.

For removal of the condensate, a condensate removal tube 23 is provided which extends coaxially within the steam tube 16. A pivotally mounted head 30 provides a cantilever support for the tube 16. The condensate syphon tube 23 is fully rigid in the tube 16 and has an inner extending portion 25 within the drum which is cantileverly supported on the tube 16. The outer extending portion 24 is supported at its outer end on a hub 21 and also supported further inwardly on syphon tube 23.

The syphon tube has an inner radially extending end 26 with a head end 27 for receiving the condensate. The head end is adjacent the inner surface 28 of the drum and has only a slight clearance 29 between the inner smooth surface of the drum and the head. While the drum is illustrated as having a smooth surface, in accordance with the principles of the invention, the position of the head is accurately and minutely adjustable relative to the surface 28, and it will be understood that the structure may be used with the dryer drum having a grooved inner surface or other configuration where the stationary head 27 must be maintained in close adjacency to the relatively rotating surface of the drum. The condensate is removed by a syphon action through a pipe 20 which connects to a fitting 19. The piping to fitting 19 will have sufficient flexibility to permit slight movement of the fitting.

A steam seal is provided to prevent the escape of steam from the drum, and this rotary seal is shown at 31 having a rotating annular face 31*a* and a stationary face 31*b*. The stationary part is self-aligning and held in sealing contact by a compression spring 32. The stationary part also has a smooth outer annular tubular surface 31*c*. The surface coacts in a sealing fashion with a flexible annular ring 33 carried in the head. The seal as illustrated is constructed so as to accommodate slight changes in angular position of the head relative to the drum which has a constant axis. In other words, the outer surface 31*c* of the sleeve portion of the seal is constantly coaxial with the drum whereas the flexible ring 33 changes its horizontal axial alignment slightly. The pivotal movement of the head which occurs with adjustment of a bolt 37 effects the change in axial alignment which is sufficiently small so that no disruption of the seal results.

For pivoting the head 30 and thereby changing the cantilever supported head end 27 of the syphon tube, the head is mounted on a pivot 34 supported on the rigid frame 11. The head has an adjustment arm 35 which has at its outer end the adjustment bolt 37. The bolt threads into a portion 36 on the rigid frame which is threaded at 39 to receive the lower end of the bolt. The arm 35 is also threaded at 38 to receive the bolt 37. The lower end of the bolt 41 coacts with the threaded opening 39, and the upper end 40 of the bolt coacts with the threaded opening 38. The threaded openings 38 and 39 and the threads of the bolt portions in the openings are threaded to a differential lead so that with rotation of the bolt, the bolt advances faster in one of the openings than in the other opening, i.e., at a different speed so as to obtain very minute pivotal movement of the arm 35 with rotation of the bolt. The bolt is readily accessible to the operator, and indexing means may be provided to show the bolt's position.

The steam tube which provides support for the condensate removal tube is adequately supported in the head with the saddle 22 and is prevented from rotation by a locking pin 43 which is threaded into the saddle 22 and which projects into an opening 45 in the steam tube. This antirotation pin 43 provides for alignment of the syphon tube relative to the drum.

At startup, steam is directed into the interior of the drum through the tube 16, and the syphon tube 23 removes condensate. The operator adjusts the adjustment bolt 37 to pivot the head 30 until the inner head end 27 of the syphon tube just touches the inner surface of the drum and this is backed off a matter of a few thousandths of an inch. With changes in expansion of the drum and expansion of the condensate tube, and movement of the frame, adjustments may be necessary, and these can be running adjustments since the adjustment bolt 37 is fully accessible to the operator during operation without affecting the continued rotation and operation of the steam drum.

An advantage over available prior art structures is that you do not have to shut down and cool the dryer and enter the drum in order to adjust the clearance, and in operation, the clearance can be adjusted on the run. There is less time required to readjust the clearance. Since adjustment can change with minor operational differences, due to wear or temperature change, the foregoing are important factors.

Thus, it will be seen that we have provided an improved micrometer adjustment attainable by the bolt 37 and its differential threading for adjusting the position of the head end 27 of the syphon tube. The structure and its operation achieves the objectives and advantages above set forth and provides improvements over devices heretofore available.

We claim as our invention:

1. A mechanism for drying a traveling web comprising in combination:

a hollow cylindrical dryer drum having an inner surface against which steam condensate collects and being rotatably supported on stationary frame means;

means for introducing steam into the interior of said drum;

a syphon tube extending into an end of the drum with an internal portion having a head adjacent the inner surface of the drum for collecting condensate and having an external portion for receiving the collected condensate;

a rotary steam seal through which the tube extends accommodating rotation of the drum without leakage of steam past the tube; and a pivotally adjustable mount for the tube on said frame means externally of the drum and an adjustment member for adjusting the angular position of the tube on said mount and thereby adjusting the spacing between the head end and the inner surface of the drum.

2. A mechanism for drying a traveling web constructed in accordance with claim 1:

wherein said rotary steam seal accommodates changes in angular alignment due to the function of said adjustment member.

3. A mechanism for drying a traveling web constructed in accordance with claim 1:

wherein said adjustment member includes coaxially male and female threaded members relatively rotatable for small adjustments for the angular position of the tube.

4. A mechanism for drying a traveling web constructed in accordance with claim 1:

wherein said adjustment member includes a rotatable threaded bolt member threadably received by a first female thread in the frame means and a second female thread in the tube, said first and second female threads having a different lead than said first thread so that rotation of the bolt will cause a differential effect for minute adjustments of the angular position of the tube.

5. A mechanism for drying a traveling web comprising in combination:

a hollow cylindrical dryer drum having an inner surface against which steam condensate collects and being rotatably supported on end journals in bearings on stationary frame means;

means for introducing steam into the interior of said drum;

a stationary rigid syphon tube extending coaxially into an end of the drum through one of the journals with an inner portion projecting adjacent the inner surface and being cantileverly supported on an outer portion;

a rotary steam seal through which the tube extends accommodating minor axial positional changes of the tube relative to the drum;

a pivotally adjustable mount for the tube supporting the external portion thereof having a fulcrum adjacent the seal and having a lever arm outwardly of the fulcrum relative to the drum; and a micrometer adjustment between the lever arm and frame means.

6. A mechanism for drying a traveling web constructed in accordance with claim 5:

wherein said micrometer adjustment includes a threaded bolt having a first portion threaded into female threads in the frame and a second portion threaded into female threads in the lever arm with said second portion having a different lead than the first portion by a differential effect with rotation of the bolt.

* * * * *